United States Patent [19]

Schippers et al.

[11] Patent Number: 4,798,347

[45] Date of Patent: Jan. 17, 1989

[54] METHOD FOR WINDING FILAMENT YARNS

[75] Inventors: Heinz Schippers; Siegmar Gerhartz, both of Remscheid, Fed. Rep. of Germany

[73] Assignee: Barmag AG, Remscheid, Fed. Rep. of Germany

[21] Appl. No.: 85,849

[22] Filed: Aug. 14, 1987

[30] Foreign Application Priority Data

Aug. 16, 1986 [DE] Fed. Rep. of Germany ..... 3627879
Oct. 24, 1986 [DE] Fed. Rep. of Germany ..... 3636151

[51] Int. Cl.[4] ..... B65H 54/02; B65H 54/28; B65H 54/38

[52] U.S. Cl. ..... 242/18 R; 242/18.1; 242/43 R; 242/43 A; 242/176; 242/178

[58] Field of Search ..... 242/18.1, 18 R, 18 DD, 242/43 R, 43 A, 159, 174, 176, 177, 178

[56] References Cited

U.S. PATENT DOCUMENTS 4,049,211 9/1977 Spescha ..... 242/18.1 X
4,296,889 10/1981 Martens ..... 242/18.1
4,371,122 2/1983 Schuller ..... 242/43 R
4,504,021 3/1985 Schippers et al. ..... 242/18.1
4,504,024 3/1985 Gerhartz ..... 242/18.1
4,505,436 3/1985 Schippers et al. ..... 242/43 A
4,515,320 5/1985 Slavik et al. ..... 242/43 R X
4,561,603 12/1985 Schippers et al. ..... 242/43 A
4,667,889 5/1987 Gerhartz ..... 242/18.1
4,676,441 6/1987 Maag ..... 242/18.1
4,697,753 10/1987 Schippers et al. ..... 242/18.1

FOREIGN PATENT DOCUMENTS 0064579 5/1981 European Pat. Off. .
47-49780 12/1972 Japan .
50-65628 6/1975 Japan .

*Primary Examiner*—Stanley N. Gilreath
*Attorney, Agent, or Firm*—Bell, Seltzer, Park & Gibson

[57] ABSTRACT

A yarn winding method is disclosed wherein the yarn is wound onto a supporting tubular core by a traversing yarn guide. During the initial portion of the winding process, the yarn is wound in a random wind process, and during the subsequent portion of the winding process the yarn is wound in a stepped precision wind.

14 Claims, 4 Drawing Sheets

Fig-3
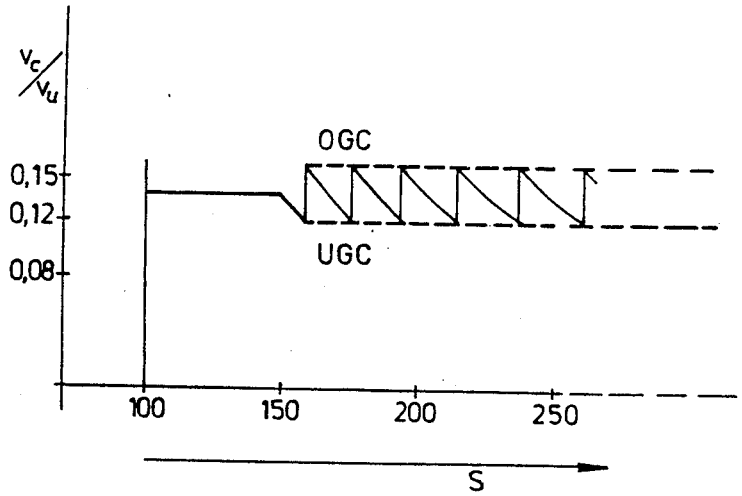
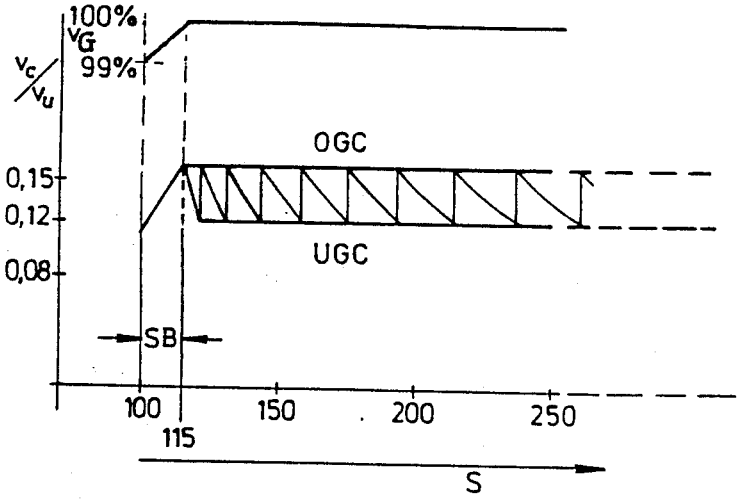
Fig-4
Fig-5
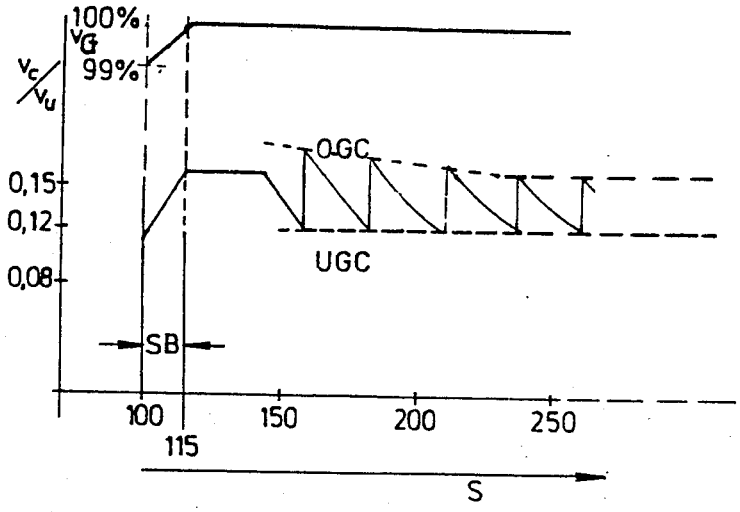

Fig-6
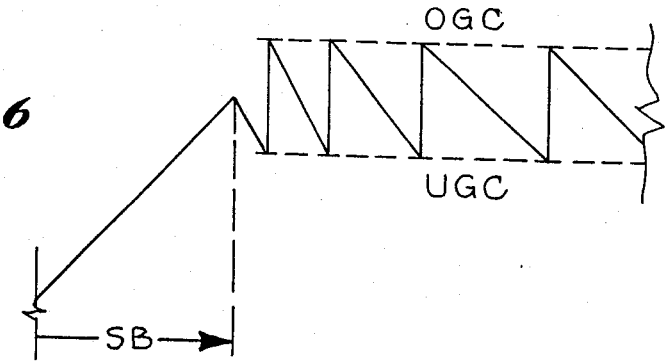
Fig-7
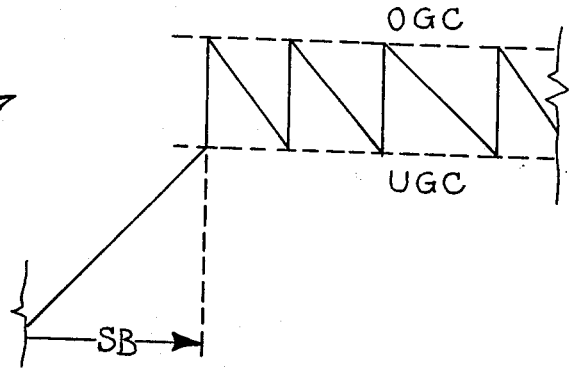
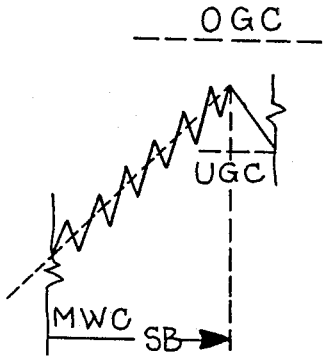
Fig-8
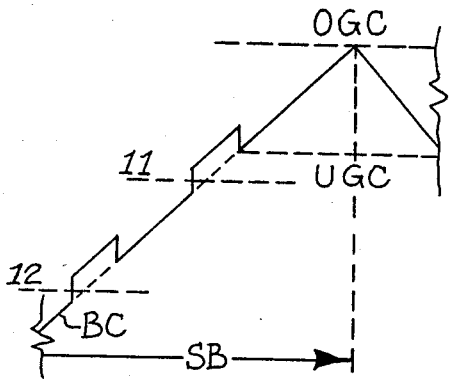
Fig-9

METHOD FOR WINDING FILAMENT YARNS

BACKGROUND OF THE INVENTION

The present invention relates to a method of winding yarns, in particular freshly spun or drawn synthetic filament yarns, to form cylindrical cross-wound packages and which involves a stepped precision winding process. In methods of the described type, it is recognized that the yarns advance at a constant speed, so that the package must be driven at a substantially constant circumferential speed.

The stepped precision winding process is known, for example, from Japanese Patent No. 50-65628, which provides that the reversal times are so determined that the winding tension remains within certain limits. At the beginning of a winding cycle, however, the traversing speed drops very quickly, in proportion to the spindle speed, since the diameter of the package increases very rapidly. As a result, the reversal times at which the traversing speed must be reversed from a lower limit value to its upper limit value, follow each other very rapidly.

The same factor applies to the method as described in U.S. Application Ser. No. 838,390, now U.S. Pat. No. 4,697,753. The method there described provides that the traversing speed is reduced first proportionately to the spindle speed between a preset upper limit and a preset lower limit in a recurring sequence of cycles, and then again increased so as to obtain a preset smaller winding ratio, and with the upper and lower limits being decreased or increased in the same sense. In the application of this method it has been found that in all phases of the winding cycle in which the upper limit and the lower limit of the traversing speed are continuously increased, many reversals of the traversing speed closely following each other are necessary. These reversals follow each other particularly closely, when the upper limit and lower limit of the traversing speed are increased at the beginning of a winding cycle. As a result of the necessity to carry out the reversal of the traverse speed very rapidly one after the other in a stepped precision wind, the expenditure for electronic equipment will greatly increase, if the winding ratios (spindle speed: traversing frequency) are maintained with adequate precision, and so as to produce a good package build.

As used in the present application, the traversing frequency and double stroke rate are defined as the number of the traverse cycles per unit of time, with each traverse cycle consisting of one reciprocating motion.

It is accordingly an object of the present invention to provide an improved winding method, particularly for man made filament yarns, wherein the expenditure for circuitry, in particular electronic equipment, may be reduced, and yet a good build of the package remains assured.

SUMMARY OF THE INVENTION

These and other objects and advantages of the present invention are achieved in the described embodiments of the present invention by the provision of a method of winding a textile yarn onto a supporting core to produce a finished yarn package having a total yarn thickness, and which comprises the steps of winding the yarn about the core at a substantially constant rate and such that the rotational speed of the package gradually decreases, while guiding the yarn onto the core by a traversing yarn guide. The method further comprises the steps of winding an initial portion of the total yarn thickness while maintaining the traversing speed at a value having no fixed relationship with the spindle speed and so as to produce a random wind, and then winding a subsequent portion of the total yarn thickness while decreasing the speed of the traversing yarn guide in proportion to the decreasing rotational speed of the package to define a substantially constant winding ratio during each of a series of sequential steps of the winding cycle, and rapidly increasing the speed of the yarn traversing guide at the end of each sequential step to produce a stepped precision wind.

The method of a stepped precision wind, as is known, for example, from U.S. Pat. No. 4,049,211 and Japanese Patent No. 50-65628, is suitable for avoiding the so-called ribbon formation. A prerequisite thereto, however, is that the predetermined winding ratios are very accurately maintained. To reduce the requirements as to accuracy, it has also been suggested that the adjusted winding ratios are at least timewise modulated at a modulation width of ±0.1% (U.S. Pat. No. 4,669,884). Aside from the lesser expenditure for electronic equipment, the method of the present invention is directed to providing for an alternative to this known method, and which requires less accuracy.

In accordance with the present invention, the portion of the winding cycle in which, due to the rapidly increasing package diameter, a particularly great accuracy is required for the adjustment of the winding ratios, is wound in a random wind, and a stepped precision wind is employed only in the other portions. The method takes into account the circumstance that just at the beginning of a winding cycle, the necessary resets of the traversing speed must be done so fast that, particularly because of the mass inertia and the vibratory behavior, the exact and sudden adjustment of a changed winding ratio by varying the traversing speed is only possible at a relatively great expenditure.

Japanese Pat. No. 47-49780 discloses a method in which at the beginning of the winding cycle a random wind is used and subsequently a precision wind is used. This is provided so as to be able to reduce the traversing speed at the beginning of the winding cycle. In the present invention, the traversing speed is reduced in that the stepped precision wind is applied, whereas the random wind serves the purpose of avoiding the changes of the traversing speed which is necessary in a stepped precision wind, in the phases of the winding cycles which call for very frequent changes with great accuracy.

Thus, according to the present invention, a random wind is applied at the beginning of the winding cycle, whereas a stepped precision wind is carried out during the remainder of the winding cycle. This is particularly advantageous, when an increase of the traversing speed is also provided at the beginning of the winding cycle.

The invention proceeds from the recognition that the ribbon problems, which develop when a yarn is wound on packages with a relatively small diameter or when the traversing speed is varied, can also be solved in a satisfactory manner and at relatively little cost, when applying the method of the random wind. It is possible to leave the traversing speed constant during the phase of the winding cycle in which the random wind is applied. This will always be possible when the developing ribbons are very rapidly traversed at a fast increasing package diameter, for example, in the case of coarse yarn deniers and high yarn speeds.

The term "random wind" as employed herein includes any winding method and traversing method, in which no fixed winding ratio, i.e. the ratio of spindle speed to traversing frequency, is maintained over a certain period of time, and in which the traversing speed is varied irrespective of the spindle speed.

Only in the remaining phase of the winding cycle is the yarn wound in a so-called stepped precision wind. In this process, an upper limit and a lower limit are preset for the traversing speed. The difference between the two should amount to about 4% of the upper limit. Then the traversing speed is lowered, first proportionately with the spindle speed, so that a certain, precalculated winding ratio is maintained. Upon or shortly before reaching the lower limit, the traversing speed is suddenly increased to a value which comes close to, or is the same as, the upper limit, and which results again in a lowered, predetermined winding ratio. Then, the traversing speed is again decreased proportionately to the spindle speed. The method of the precision wind is maintained both in the phases with a constant mean traversing speed and in the phases with a decreasing, mean traversing speed.

In the phase of the random wind, the traversing speed may additionally be superposed by ribbon breaking variations, e.g. wobbling. When wobbling is applied, the traversing speed fluctuates about its mean value with an amplitude of about 2%. Such ribbon breaking methods are described, for example, in DE-OS No. 28 55 616.

Alternatively, a method for avoiding ribbons may also be applied in which, when approaching a ribbon, the traversing speed is temporarily suddenly increased from its basic value up to a 4% higher value, which lies above the ribbon, and then again suddenly decreases to its basic value. Such a method is described in U.S. Pat. No. 4,504,021.

A further embodiment of the present invention provides that the winding tension does not reach unacceptable values and, particularly, does not change in any unacceptable manner. Especially considered is the fact that the yarn tension must be within certain limit values and that it must remain substantially constant during the course of the winding cycle. Consequently, it is further suggested that when winding a base layer of the package, the circumferential speed of the package is reduced as a function of the increase of the traversing speed, and so that the winding speed of the yarn as a geometrical sum of circumferential speed and traversing speed remains substantially constant.

The method according to the present invention has the advantage that it permits the use of a stepped precision wind also when the mean value of the traversing speed is to be very greatly increased over the stages of the winding cycle. This is particularly necessary at the beginning of a winding cycle, so as to improve the build of the package, to wind a stable package with a large winding thickness (outside diameter of the package minus core diameter), to avoid having the inner layers of the package which are deposited directly on the core slip toward the longitudinal center of the package and are therefore wound at a lesser length than the additional layers of the package, to avoid that the package exhibits bulges especially in its first third, and to avoid that the package forms castoffs, particularly at the beginning of a winding cycle. Castoffs may be defined as yarn lengths which leave the front end face of the package and lie as a secant over the inwardly positioned layers.

BRIEF DESCRIPTION OF THE DRAWINGS

Some of the objects and advantages of the present invention having been stated, others will appear as the description proceeds, when taken in conjunction with the accompanying drawings, in which

FIGS. 3–9 are diagrams of the traversing speed in accordance with the present invention;

DETAILED DESCRIPTION OF THE PREFERRED EMBODIMENTS

Figure 1:
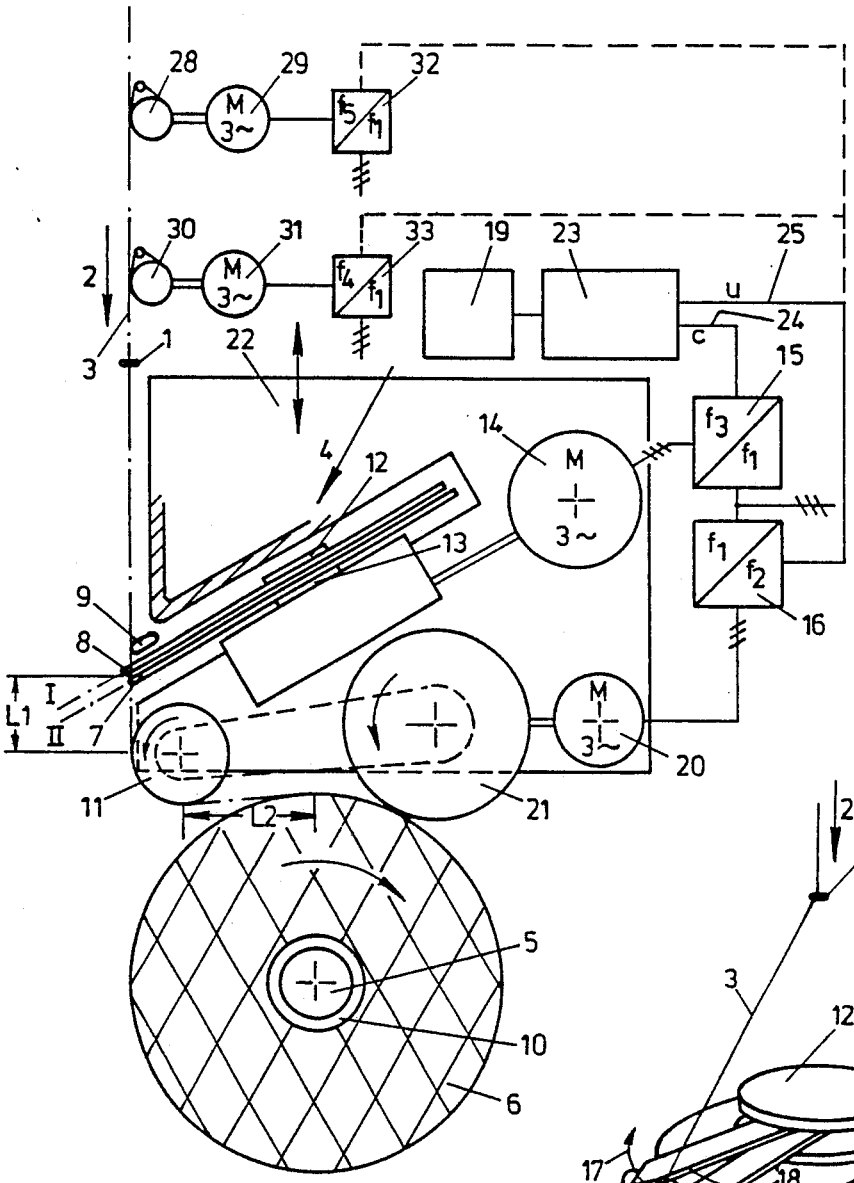
FIG. 1 is a cross sectional view of an apparatus for performing the method of the present invention.
Figure 2:
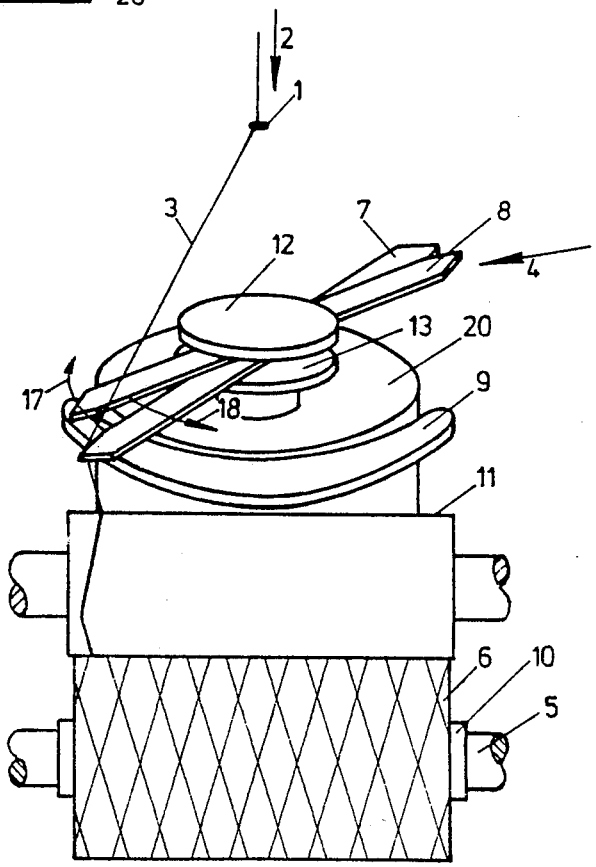
FIG. 2 is a view, partially schematic of the winding apparatus shown in FIG. 1.

Referring more particularly to the drawings, FIG. 1 illustrates the cross section, and FIG. 2 the side elevation, of a yarn winding machine, on which the invention can be carried out. More particularly, a yarn 3 continuously advances in direction 2, and is guided over draw rolls, or godets, 28 and 30, which are driven by motors 29 and 31 at different speeds. The energy which determines the speed of the draw rolls 28 and 30 is supplied by frequency inverters 32 and 33. As a result of the different speeds of draw rolls 28 and 30, the yarn is drawn between same and then advanced at a constant speed, first through a stationary yarn guide 1 and then through a yarn traversing system 4. A winding spindle 5 is freely rotatably supported, and accommodates an empty tubular core 10. The yarn 3, for example freshly spun and/or drawn synthetic filaments, and which advances at a constant speed, is wound on the empty core 10 to form a package 6. To this end, a drive roll 21 contacts and drives the empty core 10 at the beginning of the winding cycle and then the subsequently formed package 6, on its circumference at a constant circumferential speed. In so doing, the yarn 3 is reciprocated along each package by the yarn traversing system 4 which is further described below. The yarn traversing system 4 and the drive roll 21 are jointly supported on a slide 22, which can be moved upwardly and downwardly in the direction of the double arrow, so that the drive roll can make way to the increasing diameter of package 6.

From the yarn traversing system 4, the yarn 3 advances with a trailing length L1 to the roll 11, the yarn loops around the roll 11 and continues to advance with a trailing length L2 tangentially onto the core 10 or package 6. The trailing lengths L1 and L2 effect the length H (FIG. 8) at which the yarn is deposited on the core or package, and so that the length is shortened from HB to H by the increase of the traversing speed and according to the present invention, when a base layer (SB) is wound.

The yarn traversing system 4 consists of rotary blades and the roll 11 which follows the blades in the path of the advancing yarn. The yarn traversing system possesses its own drive, which is described below. The rotary blade traversing systems and roll 11 may be operatively interconnected. Alternatively, and as illustrated in FIG. 1, the roll 11 may be operatively connected to the drive roll 21. The special advantage of the illustrated yarn traversing system is that the angle at which the yarn is deposited on the package may be varied, within limits, since the traversing speed is adjustable irrespective of the winding speed. In particular, it is possible for the purpose of avoiding the formation of ribbons to have the traversing speed vary constantly about a mean value, or to switch same between two closely adjacent values, when there is the risk of a ribbon, or, to vary the same temporarily in proportion to the package speed.

The rotary blade yarn traversing system comprises a rotor 12 and a rotor 13. The two rotors may be arranged concentric or eccentric to each other, and both rotors are driven in opposite directions by a drive and gears which are accommodated in a gear box 20. The rotor 12 supports two or three or four rotary blades 8, which rotate in a plane I and in the direction of arrow 18. The rotor 13 supports the same number of rotary blades 7, which rotate in a closely adjacent plane II in the direction of arrow 17. The rotary blades guide the yarn along a guide edge 9. Each rotary blade 8 transports the yarn to the right as seen in FIG. 2, and transfers it at the end of the guide edge, to one of the rotary blades 7, which then transports the yarn in the opposite direction to the other end of the guide edge, where again one of the rotary blades 8 takes over its return.

Further details can be obtained from U.S. Pat. No. 4,505,436, DE-OS No. 34 04 303.9 and U.S. Pat. No. 4,561,603 which are incorporated hereby reference.

An asynchronous motor 14 drives the yarn traversing system 4. The drive roll 21 is driven by a synchronous motor 20 at a substantially constant circumferential speed. The three-phase motors 14 and 20 receive their power through a frequency inverter 15 and 16, respectively. The synchronous motor 20, which serves for the package drive, is connected to the frequency inverter 16, which supplies an adjustable frequency f2. The asynchronous motor 14 is operated by the frequency inverter 15, which is connected with a computer 23. The output signal of the computer 23 is dependent on the input, which is in the form of a programming unit 19, in which the course of the traversing speed, i.e. the control frequency f3 during the winding cycle, can be programmed. If a ribbon breaking procedure is included, the mean value of the traversing speed and additionally the frequency as well as the amplitude and form of the periodical deviation from the given mean value, are programmed. Alternatively, in the place of a ribbon breaking with a periodically variable traversing frequency, winding ratios may be programmed in which ribbons are to be expected. These winding ratios are primarily the so-called integral winding ratios, or winding ratios with a small denominator ($\frac{1}{2}$; $\frac{1}{3}$; $\frac{1}{4}$ . . .). These critical winding ratios are then avoided in that the traversing speed is suddenly increased from its basic value shortly before reaching a critical winding ratio, so that the critical winding ratio is jumped.

In addition, the course of the circumferential speed of the package or, as is shown here, the speed of the draw rolls 28 and 30 may be programmed. This is based upon the fact that as the traversing speed increases, the tension at which the yarn is wound on the package increases likewise. It may happen that this yarn tension adversely affects the yarn quality and/or the quality of the package, and to avoid such an adverse effect, the present invention provides that the speed of at least the draw roll 30 may be adapted to the variation of the traversing speed. Simultaneously, the speed of the draw roll 28 also may be increased correspondingly, so that the speed ratio between the draw roll 30 and 28 remains constant and, thus, the draw ratio of the yarn which occurs between the draw rolls 30 and 28 remains unchanged. The course of the speed of draw roll 30 and, possibly also of draw roll 28, may be additionally entered into the programming unit 19 and be used, via an output signal 25 of the computer for the control of frequency inverter 33 and, possibly also of frequency inverter 32, so that the speed of the draw roll 30 or, respectively, draw rolls 30 and 28 are increased to avoid an increased yarn tension.

The main task of the computer 23 is to determine the desired value of the traversing speed and details are described in U.S. Pat. No. 4,697,753. To do so, the computer first receives from the programming unit 19 the preset course of the traversing speed, the preset course of the upper limit and the lower limit of the traversing speed, as well as the predetermined ideal winding ratios. From these ideal winding ratios and the basic value of the traversing speed, the computer calculates the "ideal" spindle speeds. The values of the "ideal" spindle speeds are compared with the actual spindle speeds which are monitored by a measuring sensor (not shown) which is positioned adjacent the spindle 5. If the range of the programmed, increasing traversing speed is traversed and the computer finds that the traversing speed is in a range between the upper limit and the lower limit of the traversing speed and that a stored, ideal winding ratio exists or, respectively, that the spindle speed has reached a predetermined spindle speed, the stepped precision wind will start. To this end, the computer supplies as an output signal 24 the basic value of the traversing speed, which is likewise preset by the programming unit 19, as a desired value to the frequency inverter 15. During the following course of the winding cycle, the computer reduces this desired value proportionately to the constantly measured spindle speed, which decreases hyperbolically as the diameter of the package increases at a constant circumferential speed. The given "ideal" winding ratio thus remains constant during this step of the precision wind. As soon as the computer now finds the actually measured spindle speed identical with the "ideal" spindle speed determined by the winding ratio which is preset next as "ideal", it will supply as output signal 24 again the basic value of the traversing speed as desired value. A new step of the precision wind thus follows.

It results from the foregoing that in the described method, the upper value of the traversing speed is a fixed quantity during the course of the winding cycle. It will be always adjusted, if this quantity results in a predetermined, ideal winding ratio in relationship to the actual spindle speed.

The lower limit value of the traversing speed, however, is only a mathematical quantity, which indicates the largest permissible drop of the traversing speed, which in reality, however, is seldom or never reached and only plays a part when the upper limit value is calculated. It should be noted that the method may also be inversely controlled. The lower limit value may be preset as the real value which is approached again and again The upper limit value will then indicate the greatest permissible jump of the traversing speed upward.

However, in reality it is only approached in exceptional cases, i.e., when this upper limiting value in relation to the momentary spindle speed has by change a value which was predetermined as ideal.

For the operation of the winding apparatus the law of traversing according to the diagram of, for example, FIG. 3 or 4 or 5 may be programmed.

Plotted on the abscissa in the diagrams of FIGS. 3, 4 and 5 is the layer thickness S of the package, proceeding from a core diameter of 100 mm. Plotted on the ordinate is the ratio of the traversing speed and the circumferential speed of the package, with the circumferential speed of the package being substantially constant. Said otherwise, the ordinate shows the tangent of the angle of deposit, which is defined by DIN 61800 [German Industrial Standards], as further described below.

The diagram of FIG. 3 shows that at the beginning of the winding cycle, i.e. at the core diameter of 100 mm, first a certain constant traversing speed is preset, the average angle of deposit of which, for example, equals 5°. This traversing speed may be superposed with a ribbon breaking of a known method, so that only the mean value of the traversing speed is constant.

The constant traversing speed is maintained until a predetermined, first ideal winding ratio is reached. At that point the package has reached a thickness at which the diameter no longer rapidly change to any great extend. Upon reaching this ideal winding ratio, the traversing speed is decreased proportionately to the decreasing spindle speed and until the traversing speed reaches approximately its lower limit value UGC. As previously indicated, the traversing speed is now suddenly increased again up to approximately its upper limit value OGC, so that the next programmed ideal winding ratio is reached. This next winding ratio is maintained, since the traversing speed is now again lowered proportionately to the spindle speed until it reaches the lower limit value UGC.

From the above, it will be seen that a stepped precision wind is thereafter carried out, which is started only when the spindle speed decreases relatively slowly. As a consequence, the traversing speed also decreases only relatively slowly in the individual stages of the stepped precision wind, so that in each stage, i.e., between the upper limit value OGC and the lower limit value UGC of the traversing speed, an adequately long time is available to permit the winding machine and the electronic control to reach a stable operation.

In the method as shown in the diagram of FIG. 4, the traversing speed or, respectively, the quotient as plotted on the ordinate at the beginning of a winding cycle, i.e. at a tube diameter of 100 mm, is set relatively low, so that an average yarn deposit angle of about 5° results. Within the relatively small base layer having a thickness SB, the traversing speed is then steadily increased until an average angle of deposit which is at least 3° greater is reached. After the winding of the base layer with a thickness SB, the traversing speed has reached the range between the upper limit OGC and the lower limit UGC of the traversing speed.

More specifically, during the programmed course of the traversing speed according to FIG. 4, the increasing traversing speed reaches its upper limit OGC after the base layer SB has been wound. Now, the traversing program is switched to stepped precision wind, and as a result, the traversing speed thereafter decreases proportionately with the spindle speed down to the region of the lower limit UGC of the traversing speed. Then the traversing speed is again suddenly increased up to the range of the upper limit, etc.

In the modified traversing program of FIG. 6, a reversal occurs while winding the base layer, when the computer finds that the increasing traversing speed reaches a winding ratio which represents the first programmed ideal winding ratio of the stepped precision wind.

In the modified traversing program of FIG. 7, a reversal to the stepped precision wind occurs when the increasing traversing speed reaches its lower limit UGC. In this case, the traversing speed is suddenly increased up to the region of its upper limit, as soon as the upper limit in relation of the spindle speed results in the first ideal winding ratio of the stepped precision wind. Then the traversing speed is lowered proportionately to the spindle speed, so that this first programmed winding ratio of the stepped precision wind is operated.

As is illustrated in FIG. 8, a ribbon breaking may also be carried out by periodically or aperiodically, varying the traversing speed while the base layer SB is wound. The mean value MWC of the traversing speed increases steadily, as was previously described for the traversing speed when winding the base layer SB. The actual value of the traversing speed fluctuates with an amplitude of ±1% about the mean value MWC. It is known from the prior art that this effectively avoids the effects of the ribbon formation.

FIG. 9 illustrates still another method of avoiding ribbons when winding the base layer SB. Plotted in the diagram of FIG. 9 are the ribbon values 12 and 11. In this range of the traversing speed, the winding ratio of spindle speed to traversing frequency is an integral number equaling 12 or 11, respectively. In this method, the base value of the traversing speed increases, as was previously described for the traversing speed, and as soon as the increasing base value of the traversing speed approaches the region of a ribbon, the traversing speed is suddenly increased. The increased value is then maintained until a reversal is possible without incurring the risk of a ribbon formation. The basic value of the traversing speed is indicated at BC as a rising straight line along the windings SB of the base layer. In the region of the ribbons 12 and 11, the traversing speed is temporarily increased and then reversed to the value of the basic traversing speed BC which was increased in the meantime.

In evaluating the illustrations of the FIGS. 6–9, it should be recognized that these Figures also use the abscissas and ordinates as defined with respect to FIG. 4, in an enlarged scale.

Referring now to the diagram of FIG. 5, there is illustrated a method wherein there is an increasing traversing speed at the beginning of the winding cycle and while winding a base layer with a thickness SB totaling 15 mm. To this extent, the method corresponds to that of FIG. 4. When the layer thickness SB is reached, the traversing speed is no longer increased. Rather, it remains constant until a layer thickness totaling 50 mm is wound. As can be seen, the random wind thus comprises two phases, i.e., one phase during which the traversing speed is increased, and another phase during which the traversing speed remains constant. During both phases, the usual methods of breaking ribbons may be used and superposed. When an overall layer thickness of 50 mm is reached, i.e., the traversing speed reaches a preset, first ideal winding ratio, the traversing speed is lowered in a first phase of the stepped precision wind proportionately to the spindle speed, and from this point forward a stepped precision wind is practiced.

In the methods of FIGS. 3 and 4, the distance between the upper limit and the lower limit of the traversing speed, i.e., the jump distance, is constant in the stepped precision wind. However, it is also possible to increase or decrease the so-called jump distance in one or more phases of the winding cycle.

An enlarged jump distance has the advantage that the time interval between reversals is increased. Consequently, an enlarged jump distance is primarily used at the beginning of a winding cycle, i.e., at the start of the stepped precision wind phase. Then, the jump distance may be steadily or continuously shortened, since also the reversal frequency is reduced. This is illustrated in conjunction with FIG. 5. More particularly, in the method of FIG. 5, the jump distance decreases at the beginning of the precision wind, in that the upper limit value of the traversing speed is first set high and then reduced to a constant value.

Included in the FIGS. 4 and 5 is a diagram of the draw roll speed vG, which is indicated as a percentage of the initial value. As can be seen from the diagram, the initial value of the circumferential speed increases about 1% while the base layer is wound, so that any unacceptable change of the yarn tension is compensated, and the winding speed remains constant in the ideal case.

Figure 10:
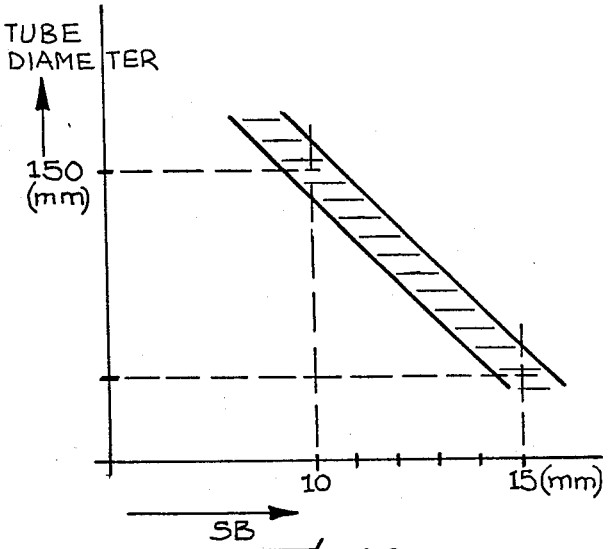
FIG. 10 is a diagram of the base layer thickness in dependence on the tube diameter.

In the methods of FIGS. 4 and 5, in which the traversing speed increases at the beginning of the winding cycle, the thickness of the base layer, during which the traversing speed increases, is limited. FIG. 10 shows the interdependence of the core diameter and the thickness of the base layer to be produced. As the latter is wound, the traversing speed increases linearly. Plotted on the ordinate is the core diameter and on the abscissa is the thickness SB of the base layer. It results therefrom that the thickness of the base layer is inversely proportional to the core diameter, and it has been found that a good, stable package build, free of castoffs, can be obtained when the aforesaid interdependence is maintained.

As can be noted from the diagram of FIG. 10 with regard to a core having an outside diameter of 100 mm, the thickness SB of the base layer, at which the maximum mean value or, respectively the maximum limit values of the traversing speed are to be reached, should range from 14 to 16 mm. For standard core diameters, this is based upon the following formula for the thickness of the base layer in dependence on the tube radius: $SB=A(100-r)/100$, with r being the core radius, specified in millimeters, and A a value between 24 and 34. Included in the factor A is the tension at which the yarn is wound. In this connection, A needs to be determined by test. The higher the winding tension the lower is the factor A.

It has been possible to reduce the tendency to form castoffs by setting the mean values or, respectively, limit values of the initial traversing speed to be sufficiently low so that the angle at which the yarn is deposited on the tube does not exceed 5°. On the other hand, the angle of deposit at the highest traversing speed should be no greater than 10°. For example, the traversing speed may be increased between $F\times\sin(2°)$ and $F\times\sin(10°)$, and preferably between $F\times\sin(4°)$ and $F\times\sin(9°)$, with F being the yarn speed.

Figure 11:
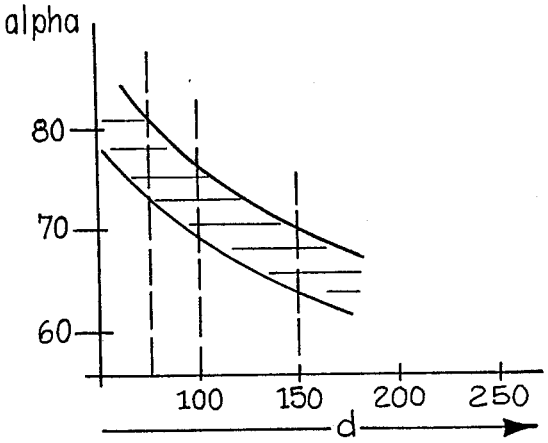
FIG. 11 is a diagram of the theoretical angle of slope over the tube diameter.

FIG. 11 illustrates the interdependence of the theoretical angle of slope alpha of the base layer and the core diameter. In order to obtain a package with flat end faces, theoretically, a more steep front end face is to be wound with a smaller core. The theoretical angle alpha is thus greater than when a base layer is wound on the core of larger diameter.

The difference to be selected between the maximum traversing speed and the minimum traversing speed or, respectively, between the greatest and the smallest angle of deposit serves to control the angle of slope. Here, the invention provides that the difference between the largest and the smallest angle of deposit should be at least 3° so as to obtain flat end faces.

Figure 12:
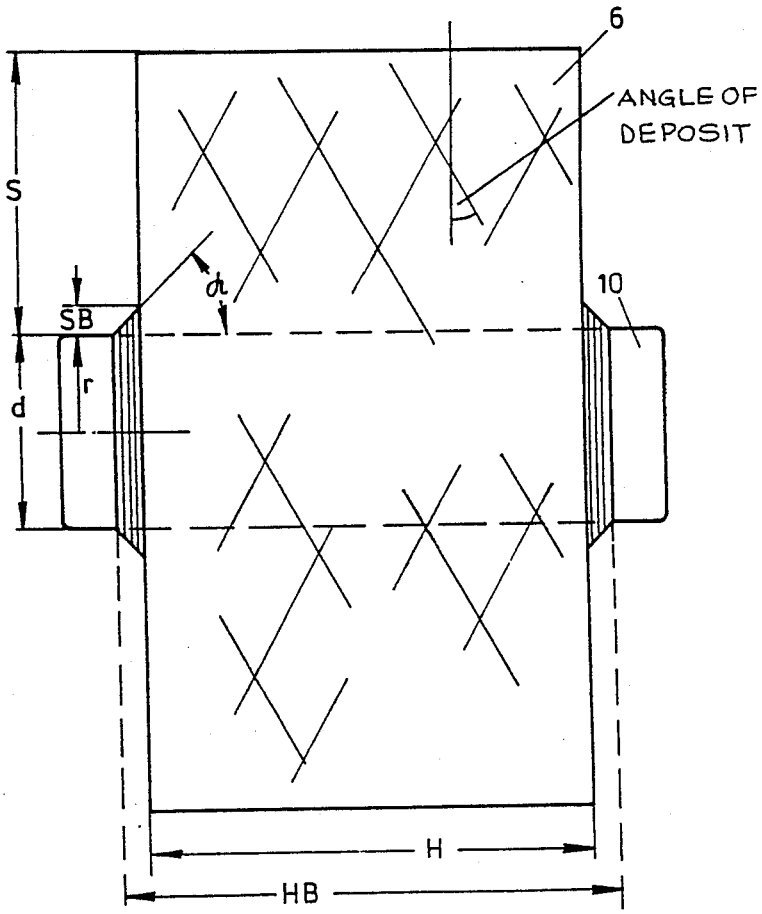
FIG. 12 is a schematic view of a cross-wound package produced in accordance with the present invention.

FIG. 12 is a schematic view of a package 6 according to the present invention, which is formed on a core 10 with a radius r and a diameter d and a total yarn thickness S. The package is cylindrical and has essentially flat end faces which extend in planes which are normal to the axis of the core. In the area of the base layer with the thickness SB, the package has theoretically inclined end faces at a theoretical angle of slope alpha. It should be understood, however, that the tendency of the end faces of the package 6 to bulge causes these end faces of the base layer to change or lose their inclination. Also, the angle of slope alpha as illustrated in FIG. 12 is shown so as to clearly illustrate the principle of the invention, and it should be understood that the actual angle and shape of the package may differ from the illustration. The yarn windings crossing each other on the external layers of the package have an angle of deposit as indicated, which is the angle which each yarn length has relative to a tangent placed on the package and which lies in a normal plane, and as defined in DIN 61800. As a practical result, however, the base layer serves as a lateral support for the package, which avoids that the end faces of the package laterally bulge, and the formation of castoffs.

The theoretical cone angle alpha of the base layer is between 65° and 80°. This is achieved primarily in that, starting from the smallest angle of deposit, the traversing speed is gradually increased while the basic layer is wound, until the largest angle of deposit is reached, with the difference between the smallest and the largest angle of deposit amounting, as noted above, to at least 3°.

The above, however, does not necessarily mean that the base layer of the package has in reality conical, i.e. inclined front end edges. Rather, the angle of cone of the base layer is purely theoretical and it only means that as a result of the variation of the traversing speed, the traverse stroke length is also changed by a factor of 15% to 45% of the layer thickness. This factor is referred to herein as the factor of slope B, which is the reciprocal value of the tangent of the theoretical angle of slope. Thus, B=unilateral stroke reduction/layer thickness.

In the drawings and specification, a preferred embodiment of the invention has been illustrated and described, and although specific terms are employed, they are used in a generic and descriptive sense and not for purposes of limitation.

We claim:

1. In a method of winding a textile yarn onto a supporting core to produce a finished yarn package having a total yarn thickness, and which comprises the steps of winding the yarn about the core at a substantially constant rate and such that the rotational speed of the package gradually decreases, while guiding the yarn onto the core by a traversing yarn guide, the improvement therein comprising the steps of winding an initial portion of the total yarn thickness while maintaining the traversing speed at a value having no fixed relationship with the spindle speed and so as to produce a random wind, and then winding a subsequent portion of the total yarn thickness while decreasing the speed of the traversing yarn guide in proportion to the decreasing rotational speed of the package to define a substantially constant winding ratio during each of a series of sequential steps of the winding cycle, rapidly increasing the speed of the yarn traversing guide at the end of each sequential step to produce a stepped precision wind and so as to define upper and lower limits of the yarn traversing speed during each sequential step.

2. The method as defined in claim 1 wherein said random wind includes maintaining the traversing speed at a constant value during said random wind.

3. The method as defined in claim 1 wherein said random wind includes increasing the traversing speed during said random wind, and wherein said stepped precision wind includes maintaining said upper and lower limits of the yarn traversing speed constant or so as to decrease during said stepped precision wind.

4. The method as defined in claim 1 wherein said random wind includes increasing the traversing speed in a first phase, and maintaining the traversing speed at a constant value in a second phase.

5. The method as defined in claim 1 wherein said random wind includes fluctuating said traversing speed about a mean increasing value so as to avoid the formation of undesirable ribbons.

6. The method as defined in claim 1 wherein the random wind includes rapidly changing the traverse speed when the winding ratio approaches a critical winding ratio at which undesirable ribbons would normally occur.

7. The method as defined in claim 1 wherein said stepped precision wind includes maintaining said upper and lower limits of the yarn traversing speed constant during said stepped precision wind.

8. The method as defined in claim 1 wherein said stepped precision wind includes changing said upper and lower limits of the yarn traversing speed in the same direction of change during said stepped precision wind.

9. The method as defined in claim 1 wherein said random wind includes beginning the winding of the yarn onto the core with a traversing speed having a predetermined mean value, and then increasing the mean value of the traversing speed from said initial mean value to a predetermined larger mean value.

10. The method as defined in claim 9 comprising the further step of reducing the circumferential speed of said package during the step of increasing the mean value of the traversing speed, and such that the winding speed and tension of the yarn remains substantially constant.

11. The method as defined in claim 9 comprising the further step of positively delivering the yarn toward the core, and increasing the delivery speed during the step of increasing the mean value of the traversing speed, and such that the winding speed and tension of the yarn remains substantially constant.

12. The method as defined in claim 9 wherein the step of increasing the mean value of the traversing speed from said initial mean value to a predetermined larger value produces a predetermined base layer adjacent said core, and wherein the thickness (SB) of said base layer is determined from the formula $SB=A(100-r)/100$, wherein r is the radius of said core in millimeters, and A is a selected value between 24 and 34.

13. The method as defined in claim 12 wherein said base layer has a thickness (SB) of no more than about 10% of the total yarn thickness (S) of the finished yarn package.

14. The method as defined in claim 9 wherein the step of increasing the mean value of the traversing speed results in a decreasing length (H) of the yarn being deposited on the core, and wherein the ratio of the length reduction at each end of the package to the yarn layer thickness defines a slope factor which is between about 15–45%.

* * * * *